US005937924A

United States Patent [19]

Cooper

[11] Patent Number: 5,937,924

[45] Date of Patent: Aug. 17, 1999

[54] MULTIPLE-SECTION WORKBENCH

[76] Inventor: William C. Cooper, 12827 W. 85th Cir., Arvada, Colo. 80005

[21] Appl. No.: 09/073,196

[22] Filed: May 4, 1998

[51] Int. Cl.[6] ..... B25H 1/00

[52] U.S. Cl. ..... 144/286.5; 144/286.1; 144/287; 83/477.1; 83/485; 108/143

[58] Field of Search ..... 144/1.1, 286.1, 144/286.5, 287; 83/477.1, 485, 486, 574; 108/13, 143; 269/290, 296

[56] References Cited

U.S. PATENT DOCUMENTS

| | | | |
|---|---|---|---|
| 794,809 | 7/1905 | Marsh . | |
| 1,398,611 | 11/1921 | Van Alstyn . | |
| 2,182,703 | 12/1939 | Rainwater | 45/6 |
| 4,497,353 | 2/1985 | Sproat, Jr. | 144/1.1 |
| 4,502,518 | 3/1985 | Lewin | 83/574 |
| 4,964,449 | 10/1990 | Conners | 144/286.1 |
| 5,431,206 | 7/1995 | McAllister | 144/286.1 |
| 5,653,273 | 8/1997 | Bach | 144/1.1 |
| 5,722,473 | 3/1998 | Tucker | 144/286.1 |

*Primary Examiner*—W. Donald Bray
*Attorney, Agent, or Firm*—James R. Young

[57] ABSTRACT

A workbench having multiple sections, each variable in width, connected together to form a work surface. A movable tool platform is located on each section, so that the platform is movable over the surface of the workbench section. A tool is mounted to each of the tool platforms, such that the tool is moved forward for working on a workpiece and backward to allow the front of the workbench to be used as a work surface. Thus, the workpiece is placed at the front of the workbench, and each tool needed for work on the workpiece is then moved, in turn, to the front of the workbench where it is used to perform work on the workpiece. The workbench can have a separation between the sections, to allow shavings and other waste material to fall below the work surface of the workbench and out of the way.

13 Claims, 4 Drawing Sheets

MULTIPLE-SECTION WORKBENCH

FIELD OF THE INVENTION

This invention relates to Workbenches and more particularly to workbenches that can be partitioned into multiple sections. Even more particularly, the invention relates to partitioned workbenches that have tool platforms thereon.

BACKGROUND OF THE INVENTION

It is often desired to have multiple tools available for completing work on a workpiece. In the past, this has been accomplished by providing a work area having several work benches, wherein each bench has a different tool mounted thereon. While this arrangement is workable, it requires considerable space, if several different tools are needed, and it requires that the workpiece be moved between each of the several workbenches.

If the tools are needed at a work site, then each workbench and its tool must be moved separately to the work site, and sufficient space must be made available at the work site to hold all the workbenches and tools. Often this has meant that less tools were taken to the work site than were actually needed, to save transportation problems and cost.

One prior art solution to this problem is provided in U.S. Pat. No. 5,431,206 entitled "Portable Workstation", issued Jul. 11, 1995 to McAllister. McAllister describes a workbench having multiple tools mounted thereon. Each tool is mounted such that it can be pivoted down away from the workbench, and thus out of the way. When the tool is needed, it is pivoted up into place, and the workpiece is moved into position to be used with the tool. While McAllister is an improvement over the prior art of multiple workbenches, it has some limitations. McAllister is designed to pivot the tool out of the way to a location below, or beside, the workbench. Many tools, such as common woodworking tools, are very heavy and it would be difficult to pivot these tools. For example, FIG. 1 of McAllister shows a bandsaw 28 in a position to be pivoted beneath the bench table surface 56. Most band saws are quite large for pivoting in this manner, and even when pivoted, the saw would be in the way of many workpieces. Further, the workpiece must be positioned differently for each tool, thus considerable workpiece repositioning space is required.

U.S. Pat. No. 4,497,353 entitled "Multipurpose Material Working Tool" issued Feb. 5, 1985 to Sproat, Jr. provides multiple tools on a single workbench, however, while it appears that while some of the tools are movable, they do not appear to be movable to an extent that would allow them to be moved out of the way of a workpiece. Sproat, Jr. also requires that the workpiece be repositioned each time it is to be used with a different tool.

It is thus apparent that there is a need in the art for an improved method or apparatus which allows multiple tools to be mounted to a workbench and minimizes the movement to a workpiece while being worked with the various tools. The present invention meets these needs.

SUMMARY OF THE INVENTION

It is an aspect of the present invention to provide a workbench for housing a plurality of tools.

It is another aspect of the invention to provide such a workbench that provides workspace on the workbench when the tools are not being used.

A further aspect of the invention is to allow use of the different tools on a workpiece while requiring little movement of the workpiece to allow it to be worked with each of the tools.

A still further aspect of the invention is to provide such a workbench that can be assembled into multiple sections, depending upon the number of tools needed.

Another aspect of the invention is to provide the multiple sections in various widths and lengths, wherein a width and length of a section is selected to accommodate a particular tool.

The above and other aspects of the invention are accomplished in a workbench having multiple sections that can be connected together to form a complete work surface. Each of the sections can be different widths or lengths, or they can all be the same width and length, or some combination of widths and lengths, as desired. A movable tool platform is located on each section, with the tool platform typically being mounted on wheels located in grooves at either side of the section, to allow the platform to be moved forward or backward over the surface of the workbench section. A tool is mounted to each of the tool platforms, such that the tool can be moved forward when being used or backward when not being used.

When the tool platform is moved backward it is out of the way of the front of the workbench, which can then be used as a work surface. In this manner, the workpiece is placed at the front of the workbench, and each tool needed for work on the workpiece is then moved, in turn, to the front of the workbench where it is used to perform work on the workpiece.

In addition to grooves on either side of the workbench for containing the wheels that allow the tool platform to move back and forth over the surface of the workbench, there can be a separation between the sections, alongside of the grooves, to allow shavings and other waste material to fall below the work surface of the workbench and out of the way.

BRIEF DESCRIPTION OF THE DRAWINGS

The above and other aspects, features, and advantages of the invention will be better understood by reading the following more particular description of the invention, presented in conjunction with the following drawings, wherein.

DESCRIPTION OF THE PREFERRED EMBODIMENT

The following description is of the best presently contemplated mode of carrying out the present invention. This description is not to be taken in a limiting sense but is made merely for the purpose of describing the general principles of the invention. The scope of the invention should be determined by referencing the appended claims.

Figure 1:
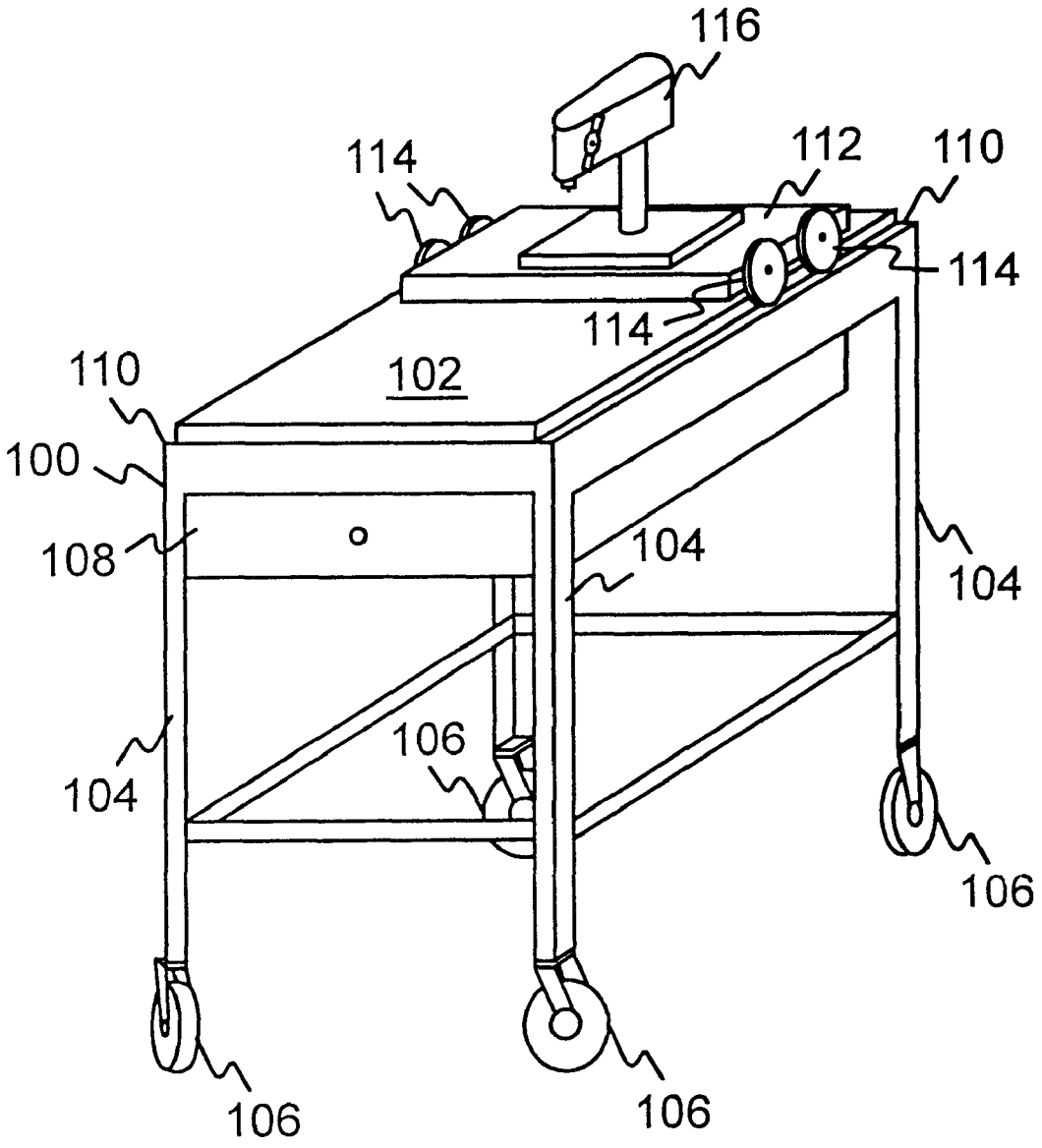
FIG. 1 shows a section of the workbench of the present invention.

FIG. 1 shows a section of the workbench of the present invention. Referring now to FIG. 1, a workbench section 100 contains an upper surface 102 which is used as a work area upon which is placed a workpiece. The section 100 is held to a comfortable work height by legs 104 which rest upon casters 106. Alternatively, the workbench section 100 would not need to have the casters 106. Optionally, a drawer 108 may be contained within the section 100 in order to provide storage space for small items.

The work surface 102 contains a pair of grooves 110 located on either side of the work surface 102. A tool platform 112 is held above the work surface 102 by a plurality of wheels 114. A tool 116 is placed on the tool platform 112. The platform 112, including the tool 116, can be moved from the rear area of the work surface 102 to the front area of the work surface 102 by rolling the platform 112 on the wheels 114 through the grooves 110. Optionally, a locking device (not shown) may be attached to the tool platform 112 and the work surface 102 to allow the tool platform 112 to be locked into either a forward or a rearward position. For example, a device could be attached to a side of the tool platform wherein a pin of the device would mate with one of several holes on a groove to allow the platform to be locked at each position wherein a hole was located.

Figure 2:
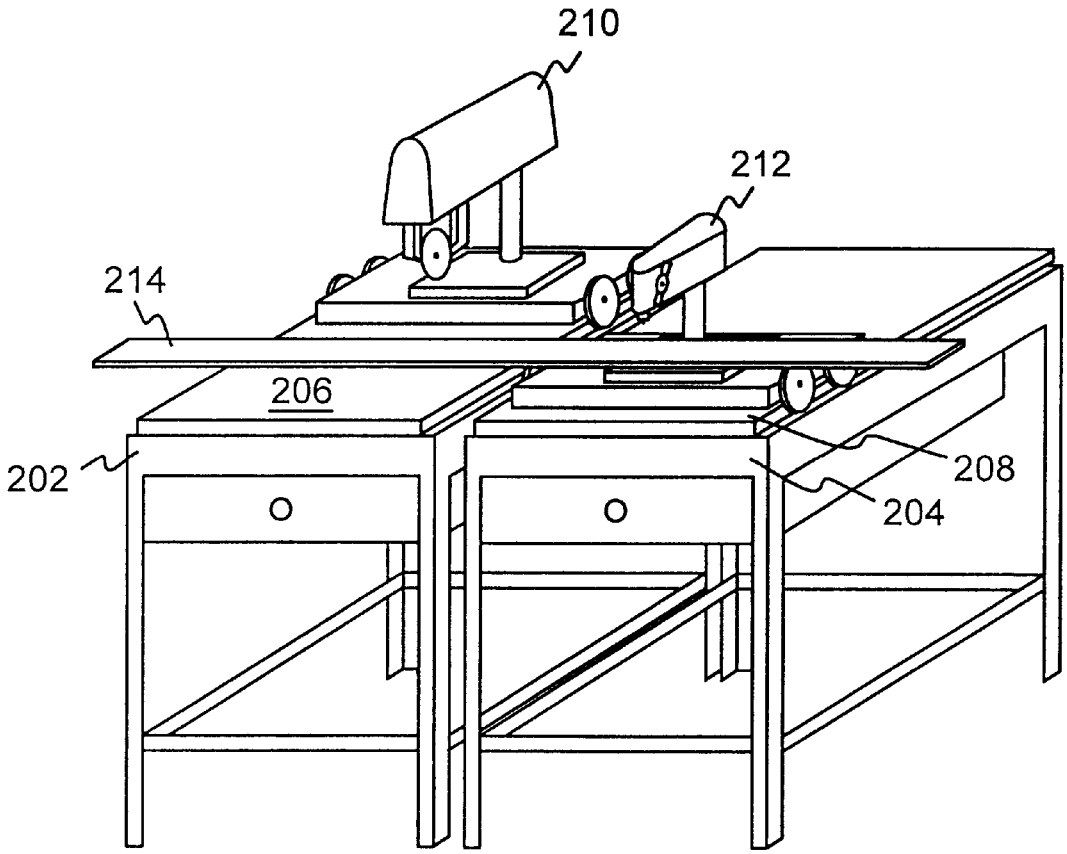
FIG. 2 shows the workbench with a tool extended to operate on a workpiece.

FIG. 2 shows the workbench of the present invention containing two sections connected together. Referring now to FIG. 2, two workbench sections 202 and 204 are connected together to form a longer workbench. Advantageously, each of the workbench sections can be of a different width, or each section may be of a different length, to accommodate different sizes of tools. As will be described below, when the workbench sections 202 and 204 are connected together a space is left between the two sections. This may be done by providing spacers between the two sections, or the legs of the sections 202 and 204 may be designed to be wider than the work surfaces 206 and 208.

A tool 210 is located on the workbench section 202 and a second tool 212 is located on the workbench section 204. In this illustration, the tool 212 has been moved to the forward area of workbench section 204 in order to allow the tool 212 to be used to work upon a workpiece 214. By moving the tool platforms, and thus the tools, to the front of the workbench when the tool is needed to operate on the workpiece, movement of the workpiece is minimized.

Figure 3:
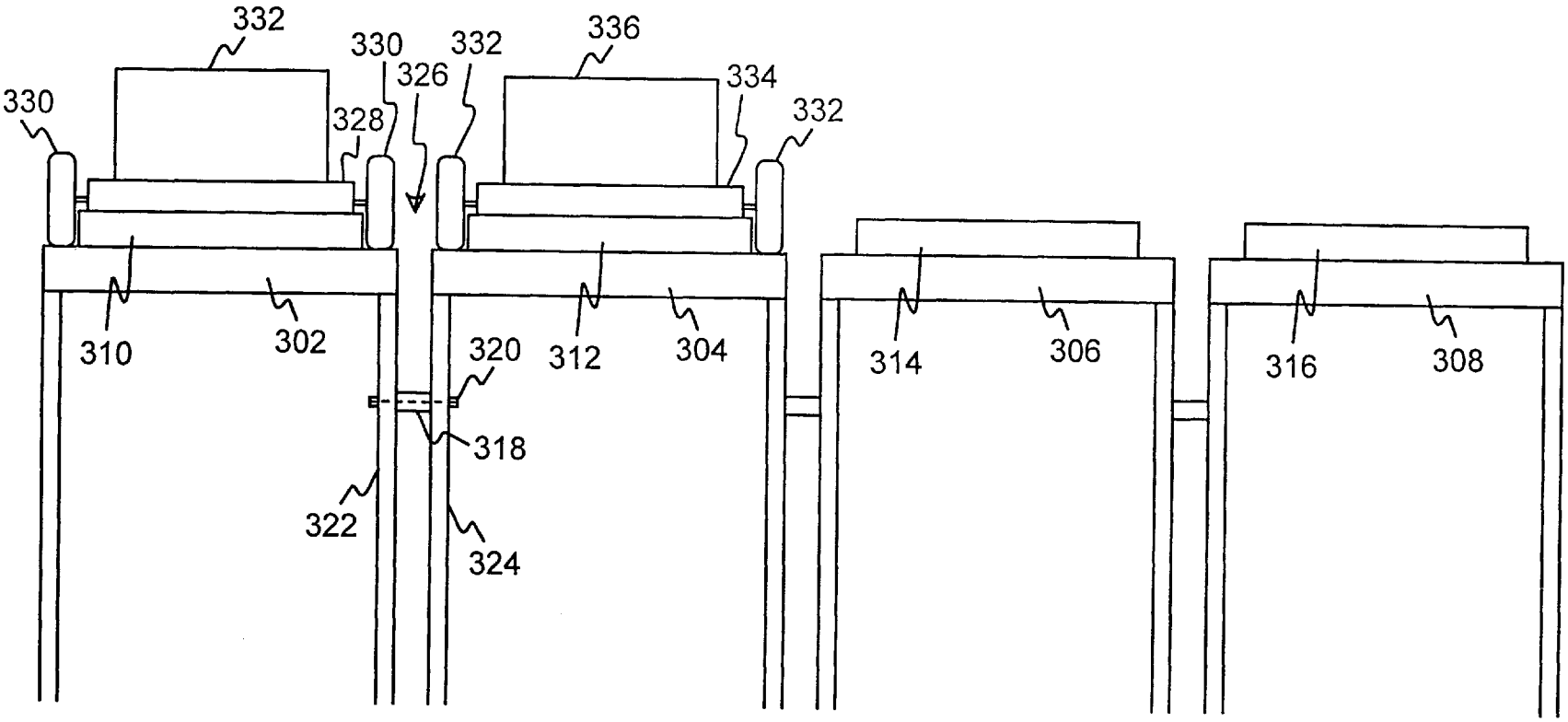
FIG. 3 shows a front view of the workbench of FIG. 1, and illustrates the tool platform above the workbench surface, and the wheels used to move the tool platform over the work surface.

FIG. 3 shows a front end view of the workbench. Referring to FIG. 3, workbench sections 302, 304, 306, and 308 are shown as viewed from the end of the workbench sections. Work surfaces 310, 312, 314, and 316 are shown on top of the workbench sections 302, 304, 306, and 308 respectively.

A spacer 318 is located between leg 322 of workbench section 302 and leg 324 of workbench section 304, and is held in place by a bolt 320. The spacer 318 separates the workbench sections 302 and 304 to allow waste material to fall in the gap 326 between workbench sections 302 and 304. Alternatively, legs 322 and 324 could be made wider, while workbench sections 302 and 304, as well as work surfaces 310 and 312, remain the same width, such that the spacer 318 would not be required in order to create a gap 326.

Tool platform 328 is located above work surface 310, and separated from the work surface 310 so that the tool platform 328 can be moved forward (outward from the figure) and backward (inward towards the figure) while being transported on wheels 330, without causing friction. A tool 332 is located on tool platform 328. Tool 332 may be attached to tool platform 328 or simply rest upon it, as desired.

Figure 4:
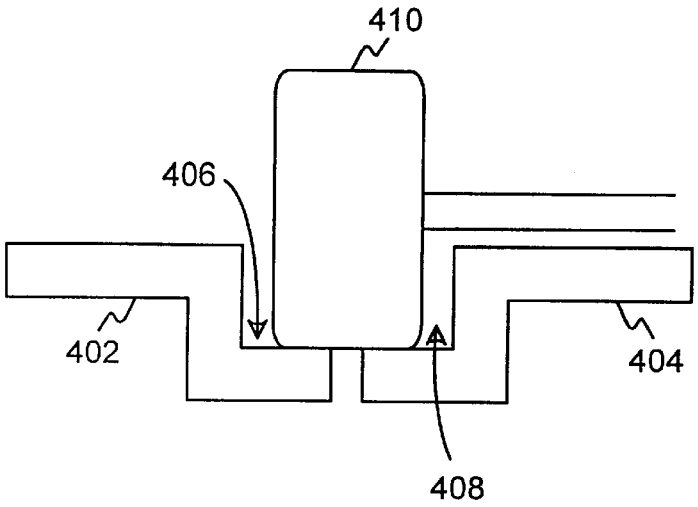
FIG. 4 shows the wheels of two tool platforms spanning the grooves of two different workbench sections.

FIG. 4 shows an alternative embodiment of the wheels connected to the tool platform of a workbench. Referring to FIG. 4, two work surfaces 402 and 404 are shown, each having grooves 406 and 408 respectively. In this embodiment, wheel 410 spans both grooves 406 and 408.

Figure 5:
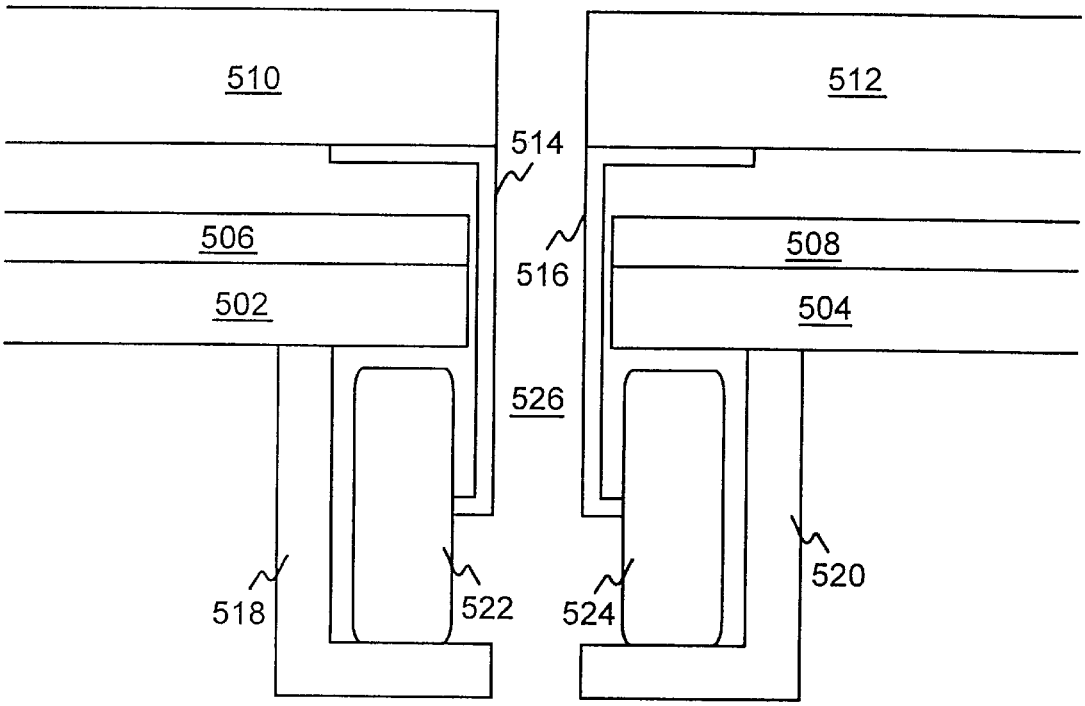
FIG. 5 shows two workbench sections with the wheels mounted below the sections.

FIG. 5 shows a second alternative embodiment for the wheels connected to a tool platform. In this embodiment, the wheels are located below the work surface, thus avoiding interference with the workpiece or waste material filling in the gap between workbench sections. Referring to FIG. 5, workbench sections 502 and 504 are shown having work surfaces 506 and 508 respectively. Tool platforms 510 and 512 are shown above work surfaces 506 and 508. Wheel attachment brackets 514 and 516 attach to the bottom of tool platforms 510 and 512 respectively, extend around the work surfaces 506 and 508, extend around workbench sections 502 and 504, and attach to wheels 522 and 524 respectively. Wheels 522 and 524 ride within angle brackets 518 and 520, below the workbench sections 502 and 504. Since the wheels 522 and 524 are below the work surfaces, waste material falling through gap 526 will not be trapped by the wheels 522 and 524, and since the grooves have been eliminated in this embodiment, waste material will not be caught in grooves, thus it will flow more freely to the floor.

Having described a presently preferred embodiment of the present invention, it will be understood by those skilled in the art that many changes in construction and widely differing embodiments and applications of the invention will suggest themselves without departing from the scope of the present invention, as defined in the claims. The disclosures and the description herein are intended to be illustrative and are not in any sense limiting of the invention, defined in scope by the following claims.

What is claimed is:

1. A workbench for holding at least one tool for performing work on a workpiece, the workbench comprising:

at least one workbench section, wherein the at least one workbench section has a work surface;

a tool platform, located above the at least one workbench section, wherein a tool may be located on the tool platform;

a mounting device connecting the tool platform and the at least one workbench section to allow the tool platform to move to at least two work areas of the workbench section, the mounting device comprising a pair of wheel channels located below the at least one workbench section, wherein a first channel of each pair is located on a first side of the at least one workbench section and a second channel of each pair is located on a side opposite the first side of the at least one workbench section, at least one pair of wheels movably mounted within the wheel channels, wherein a first wheel of each pair is movably mounted within the first channel and a second wheel of each pair is movably mounted within the second channel, and a pair of wheel mounting brackets corresponding to each pair of wheels, wherein the wheel mounting brackets connect to the tool platform and extend from the tool platform, alongside the work surface of the at least one workbench section, to mount the wheels below the work surface in the channels, wherein a first wheel mounting bracket of the pair mounts the first wheel of each pair and a second wheel mounting bracket of the pair mounts the second wheel of each pair;

wherein the tool platform is moved into a work area of the at least one workbench section to perform work on the workpiece, and is moved to a second work area of the at least one workbench section when not being used, and further wherein when a tool platform is moved to the second work area of the at least one workbench section, the first work area is available for use in holding the workpiece.

2. A workbench for holding a plurality of tools for performing work on a workpiece, the workbench comprising:

a plurality of workbench sections, each having a work surface, wherein the workbench sections are connected to form an extended workbench surface;

a plurality of tool platforms, one corresponding to, and located above, each of the workbench sections, wherein a tool may be mounted to each of the tool platforms;

a plurality of movable mounting devices, wherein at least one movable mounting device connects each of the tool platforms to a corresponding workbench section;

wherein a tool platform containing a tool is moved into a work position to perform work on the workpiece, and is moved out of the work position when not being used, and further wherein when a tool platform is moved out of the work position a usable work surface remains in place of the tool platform.

3. The workbench of claim 2 wherein all work surfaces are at a same predetermined height.

4. The workbench of claim 2 wherein each of the movable mounting devices comprises a wheel mounted to the corresponding tool platform and resting upon the work surface of the workbench section.

5. The workbench of claim 4 wherein each wheel is mounted within a groove within the workbench surface.

6. The workbench of claim 5 wherein each groove is located at a side of the work surface of the workbench section containing the groove.

7. The workbench of claim 6 wherein a separation is located between adjacent grooves such that the separation is between adjacent workbench sections.

8. The workbench of claim 6 wherein the wheels for a tool platform span grooves from adjacent workbench sections.

9. The workbench of claim 4 further comprising:

a pair of wheel channels located below each workbench section, wherein a first channel of each pair is located on a first side of each workbench section and a second channel of each pair is located on a side opposite the first side of the workbench section;

at least one pair of wheels mounted within the wheel channels, wherein a first wheel of each pair is mounted within the first channel and a second wheel of each pair is mounted within the second channel;

a pair of wheel mounting brackets corresponding to each pair of wheels, wherein each wheel mounting bracket connects to the tool platform and extends from the tool platform, alongside the work surface of the workbench section, to mount a wheel below the work surface in a channel, wherein a first wheel mounting bracket of the pair mounts the first wheel of each pair and a second wheel mounting bracket of the pair mounts the second wheel of each pair.

10. The workbench of claim 2 wherein a separation is located between adjacent sections.

11. The workbench of claim 2 wherein each of the sections contains movable means at lower extremities to allow the workbench to be movable upon the movable means.

12. The workbench of claim 2 wherein at least two of the workbench sections have different widths.

13. The workbench of claim 2 wherein at least two of the workbench sections have different lengths.

* * * * *